US005941749A

United States Patent [19]

Brunetti et al.

[11] Patent Number: 5,941,749

[45] Date of Patent: Aug. 24, 1999

[54] AUTOMATIC POSITIONING MECHANISM

[75] Inventors: Andrea Brunetti; Emilia Norberti Innocenti; Carlo Cipriani, all of Florence; Giancarlo Rassitti; Alvaro Tagliaferri, both of Sesto Fiorentino, all of Italy

[73] Assignee: Spemac S. R. L., Florence, Italy

[21] Appl. No.: 08/988,707

[22] Filed: Dec. 11, 1997

[30] Foreign Application Priority Data

Dec. 20, 1996 [IT] Italy ..... FI96A0303

[51] Int. Cl.[6] ..... H01J 9/44

[52] U.S. Cl. ..... 445/63; 445/66

[58] Field of Search ..... 445/3, 63, 66, 445/67, 800

[56] References Cited

U.S. PATENT DOCUMENTS

| | | | |
|---|---|---|---|
| 3,844,006 | 10/1974 | McGlashan | 445/36 |
| 4,163,308 | 8/1979 | Tawa et al. | 445/3 |
| 4,405,950 | 9/1983 | Wardell, Jr. | 445/3 |

FOREIGN PATENT DOCUMENTS 83 06834 11/1984 France .

*Primary Examiner*—Kenneth J. Ramsey
*Attorney, Agent, or Firm*—McGlew and Tuttle, P.C.

[57] ABSTRACT

Automatic object-positioning mechanism, comprising means for supporting the object (1), means for sensing positioning errors, means for moving the means which support the object under control (1), means for activating the means which move the object-supporting means, wherein the means for supporting the object (1) comprise an element (31), a floating plate (3) mounted on a plurality of guides (4) located at the end of two orthogonal axes and to which ball joints (6) provided with threaded bush (7) are associated; wherein the means for moving the means which support the object under control (1) are made up of a plurality of worm screws (8) engaged to electric servomotors (9), said worm screws being oriented parallel to the centering axis (h—h) of the object under control (1), being supported by a fixed frame (5) and engaging the threaded bush (7) of said ball joints (6) so that, by suitably moving the pairs of opposite screws (8), there is obtained a corresponding movement of the object about the center of the centering axis; and wherein said flat element (31) can freely rotate about the axis (h—h), independently of the floating plate (3), and is provided with at least one toothed element (32) mashing with a screw (33) driven by a motor (34) for the rotation of the element (31) and, thus, of the object (1) about the centering axis.

5 Claims, 6 Drawing Sheets

AUTOMATIC POSITIONING MECHANISM

SPECIFICATION

The present invention refers to an automatic positioning mechanism. It is known that in a wide range of technical applications of industrial interest, it is necessary to provide for the placement, that is, the positiong and spazial orientation in a preset frame of reference, of objects of various nature, under strict observance of close tolerances. This is the case, for example, of the positioning of a deflection yoke or "deflector" on the neck of cathode-ray tubes for the reproduction of images and colors, the assembly of lens in precise optical instruments, the assembly of aerials or parts thereof in devices for the transmission and/or reception of electromagnetci signals and, more generally, for the assembly of parts of complex devices in which the correct disposition of at least one component is crucial for the proper operation thereof. More particularly, it is known that upon the assembly of the deflection yoke on a cathode-ray tube for the reproduction of color images, it is necessary to very accurately adjust the position of the yoke over the tube, in order to achieve a reproduced image of good quality. The purpose of this adjustment is to cause the "electronic beams" related to the three primary colors—red, green and blue—to hit the corresponding triads of phosphors laid on the inner surface of the tube screen and intended to generate the actual colors, so as to compensate for the work errors of the yoke and of the tube. To make such adjustment, it is necessary to suitably move the yoke with respect to the tube. More specifically, for the correction of the beams convergence, the yoke must be oriented with respect to the screen surface, while the correction of colors impurity requires the yoke to be moved along an axis perpendicular to the screen. For a proper geaometrical leveling of the image, the yoke must be rotated about such an axis. Until now, the above adjustments have been conventionally carried out by manual, semiautomatic or fully automatic procedures which provide, essentially, for the movement of the yoke by an operator or by means of electromechanical actuators, so as to obtain displacements of the yoke of an extent and direction related to the errors of convergence and purity sensed by suitable instruments for the analysis of the image reproduced on the tube screen: the errors thus detected are either suitably coded and signalled to the operator who provides for actually moving the yoke in case of a semi-automatic procedure, or converted into signals which control the means for moving the yoke on the tube's neck in case of an automatic procedure.

A device for the placement of a deflector over the neck of a cathode-ray tube is known from document FR 8306834.

However, the known devices result either of complex construction or of reduced accuracy in relation to the current production requirements.

The main object of the present invention is to overcome the above said drawback and provide an automatic positioning mechanism exhibiting high reliability, being relatively simple to make, economical and suitable for the positioning of objects of various nature.

This result has been achieved, according to the invention, by providing a mechanism having the characteristics disclosed in the claim 1. Other characteristics being set forth in the dependent claims.

The advantages deriving from the present invention lie essentially in that it is possible to carry out the positioning of objects of various nature with extreme accuracy and ensure a perfect reproducibility of the positiong process owing to the mechanical rigidity of the apparatus and to the absence of clearance; that the present mechanism is of simple manufacturing, allows a significant reduction of maintenance interventions and is economical and reliable even after a prolonged life service.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1:
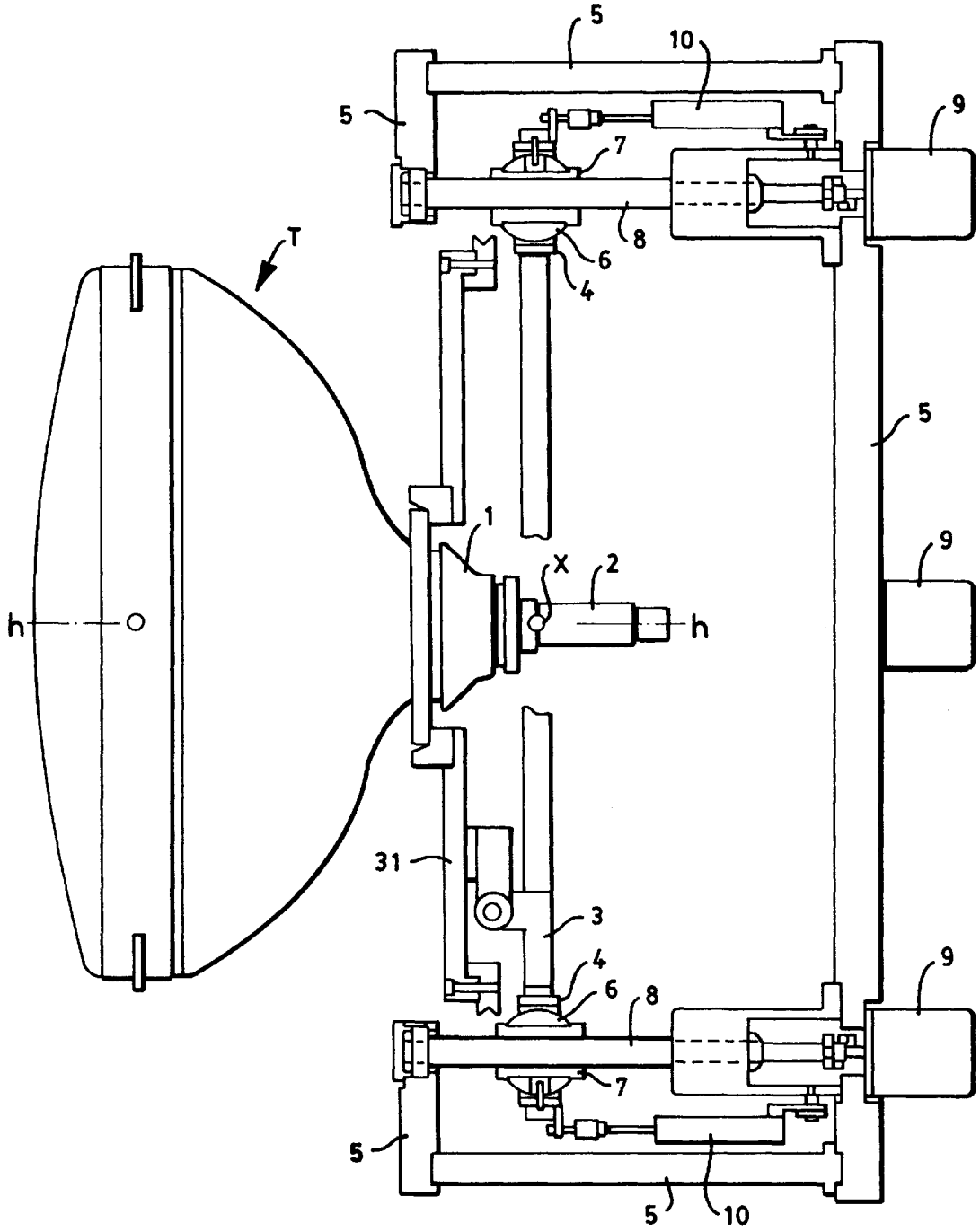
FIG. 1 shows an ensemble view, partly in section, of an automatic mechanism for the positioning of a deflection yoke over the neck of a cathode-ray tube according to the invention, the deflection yoke being in vertical position.
Figure 2:
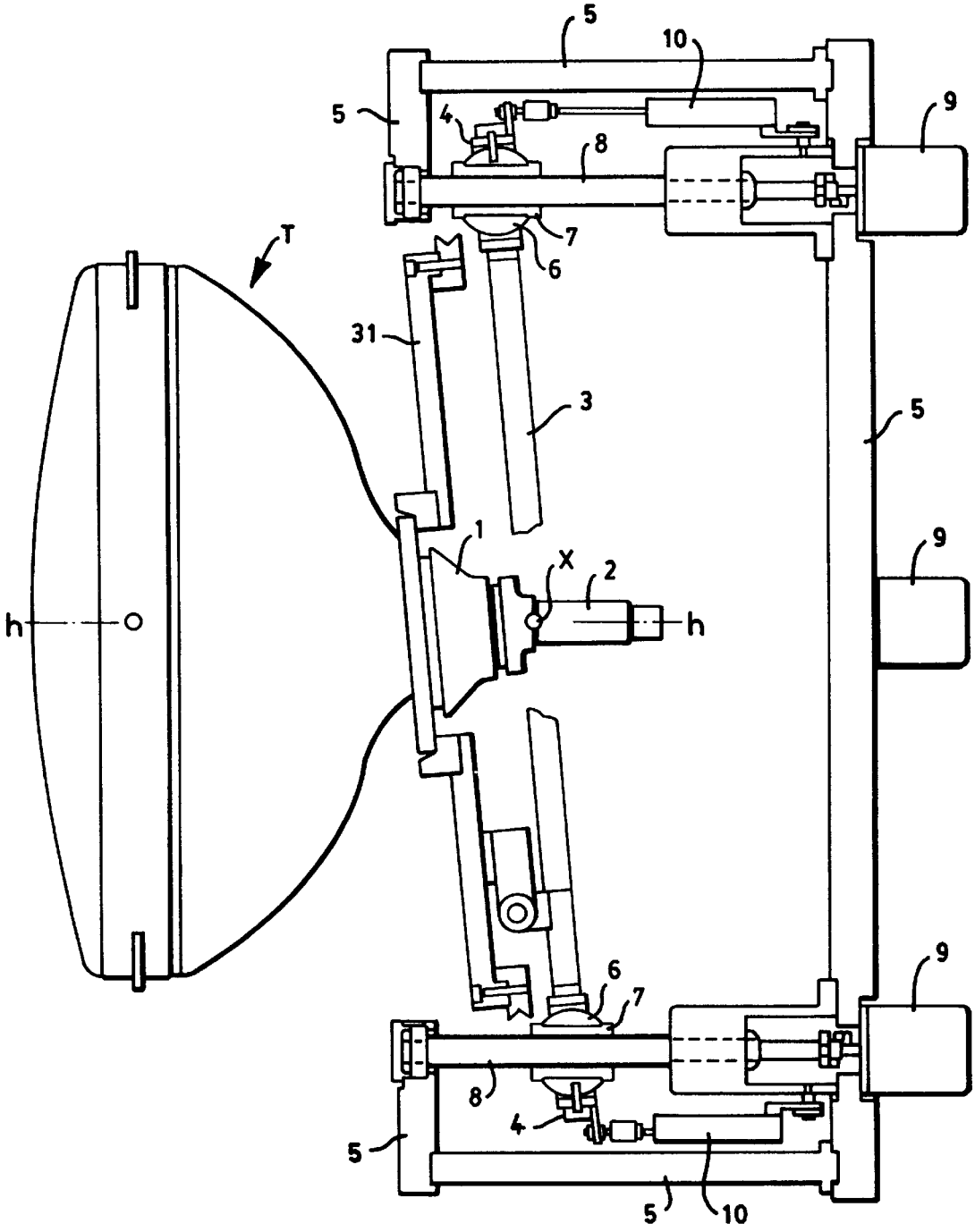
FIG. 2 shows the mechanism of FIG. 1 with the deflection yoke being inclined.
Figure 3:
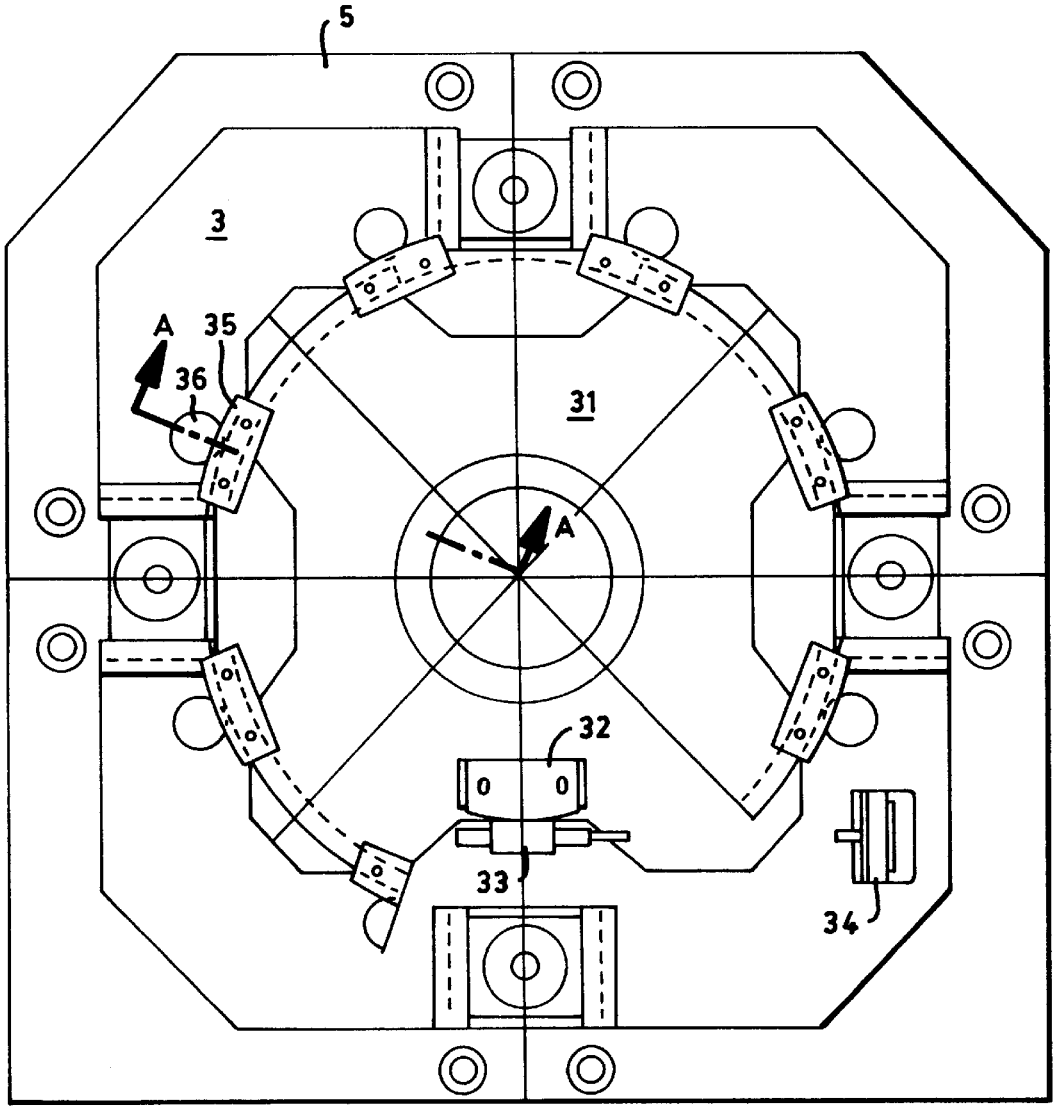
FIG. 3 shows a top view of the mechanism of FIG. 1.
Figure 4:
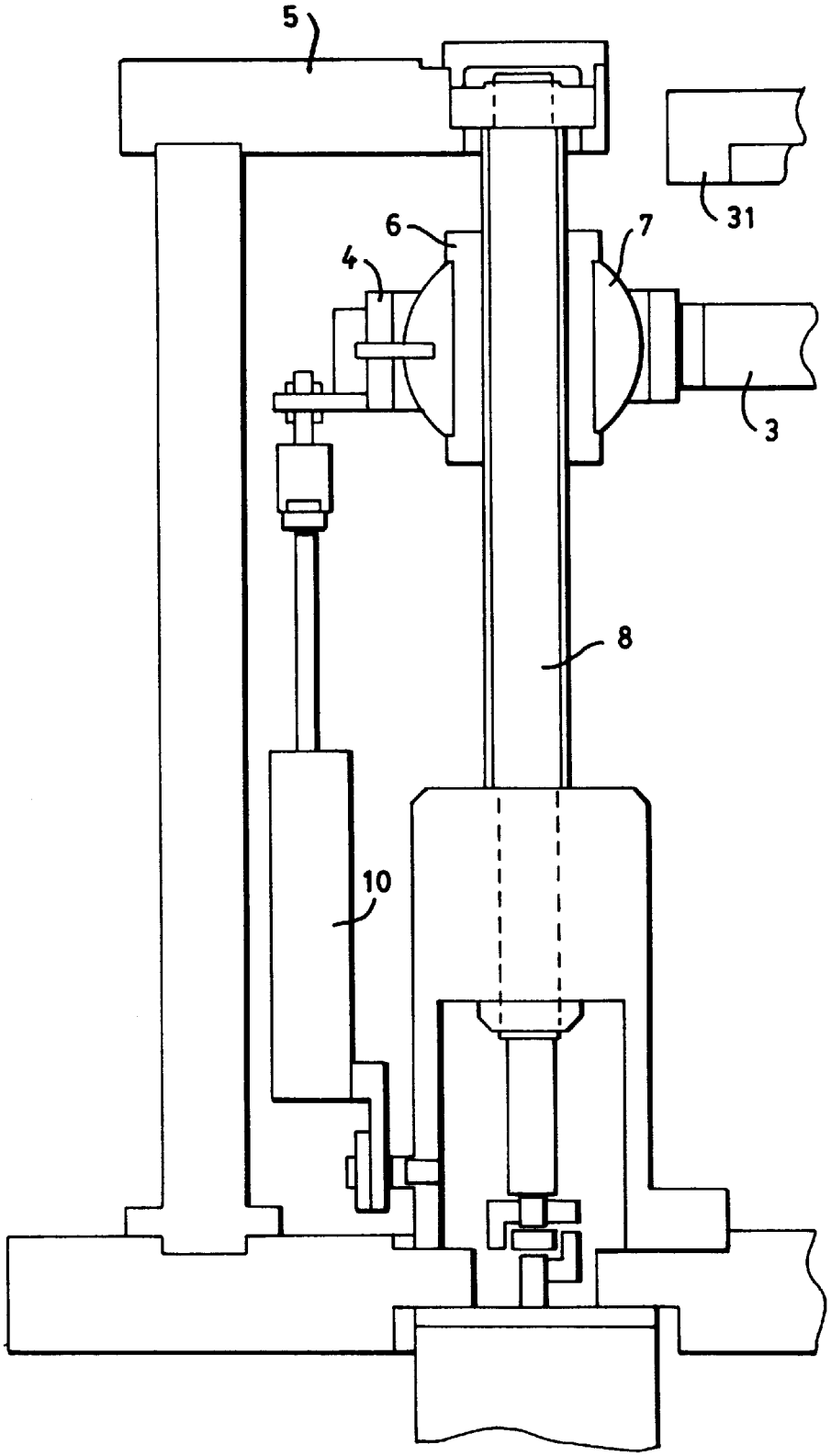
FIG. 4 shows an enlarged view of one of the means for the inclination of the deflection yoke of the mechanism of FIG. 1.
Figure 5:
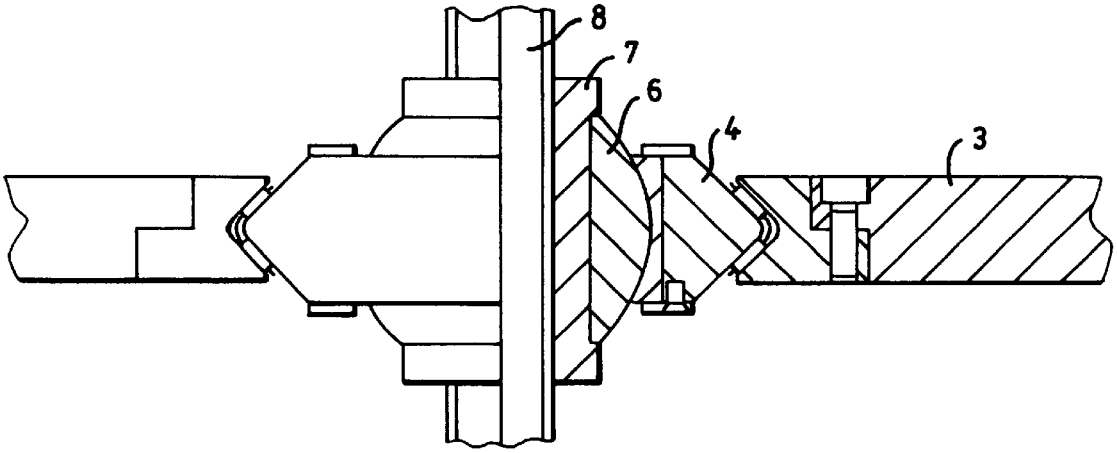
FIG. 5 shows an enlarged view, partly in section, of an articulation of the floating plate in the mechanism of FIG. 4.
Figure 6:
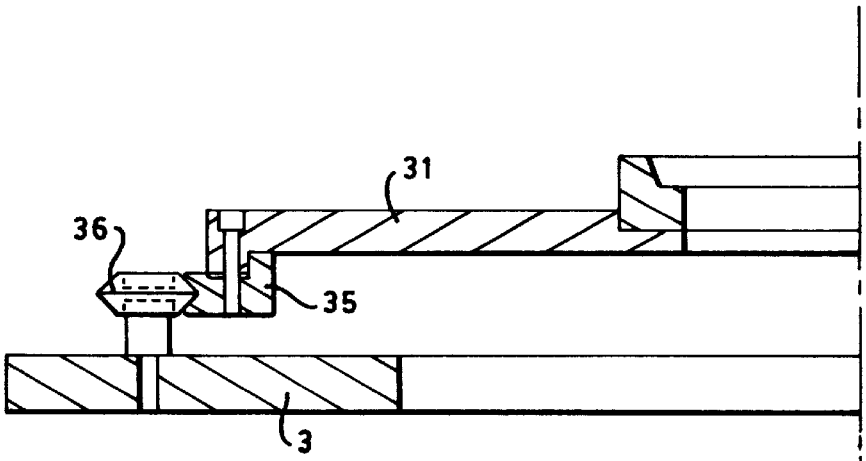
FIG. 6 shows an enlarged sectional view taken on line A—A in FIG. 3.

Reduced to its basic structure, and reference being made to the figures of the attached drawings, an automatic mechanism for positioning a deflection yoke (1) over the neck (2) of a cathode-ray tube (T), especially for the reproduction of colored images, according to the invention, comprises means for moving the yoke (1) which are engaged to means for the detection of errors of convergence of the electronic beams relevant to the three primary colors, and of errors of purity of the colors, so that the yoke (1) moving means will result activated as a consequence of the possible errors of convergence and/or purity: the moving of the yoke (1) being accomplished by displacements of an extent and direction related to the nature and magnitude of the detected errors.

Advantageously, according to the invention, said yoke (1) moving means comprise a floating plate (3) which cooperate with a flat element (31) for supporting the yoke (1) of circular profile, disposed parallel above the floating plate (3) which is mounted, at the ends of two axes orthogonal to each other, on four straight slide guides (4) each of which is associated to a corresponding ball joint (8) wherein a nut-like threaded bush (7) is housed for engaging the thread of a worm screw (8) operable by an electric servomotor (9) and oriented parallel to the longitudinal axis (h—h) of the tube (T). Going through each pair of opposite ball joints (6), which correspond to the orthogonal opposite axes of the floating plate (3), is a barycentric axis of the same plate. Said screws (8) are advantageously supported equidistnat angularly from a frame (5) and disposed in such a way that the axes of the screws (8) provided in correspondence of two facing sides of the flaoting plate (3) define a plane passing through the baricenter of the same plate. In this way, by using four screws (8), that is, two screws (8) for each orthogonal axis of the floating plate (3), two planes will be defined orthogonal to each other and passing through said barycenter of the plate (3).

The rotation of each screw (8) drives into motion the corresponding joint (6). As a consequence, the synchronized rotation of the four servomotors (9), in the same direction, entails the translation of the floating plate (3), with the corresponding translation of the yoke (1) in the direction of the longitudinal axis (h—h) of the tube (T) so as to correct the errors of purity. Moreover, with the synchronized, opposite rotation of the servomotors (9) associated to the screws (8), the latter resulting in correspondence of two facing sides of the floating plate (3), there is obtained the inclination, in one direction or the other, of the floating plate (3) and thus of yoke (1) about the axis which unites the two joints (6) associated to the non activated servomotors (9) and passes through the barycenter of the floating plate (3). By suitably moving the alternate pairs of servomotors (9), the yoke (1) can be moved on a spherical surface with centre in (x) (see FIG. 1) so as to correct the errors of convergence.

Figure 7:
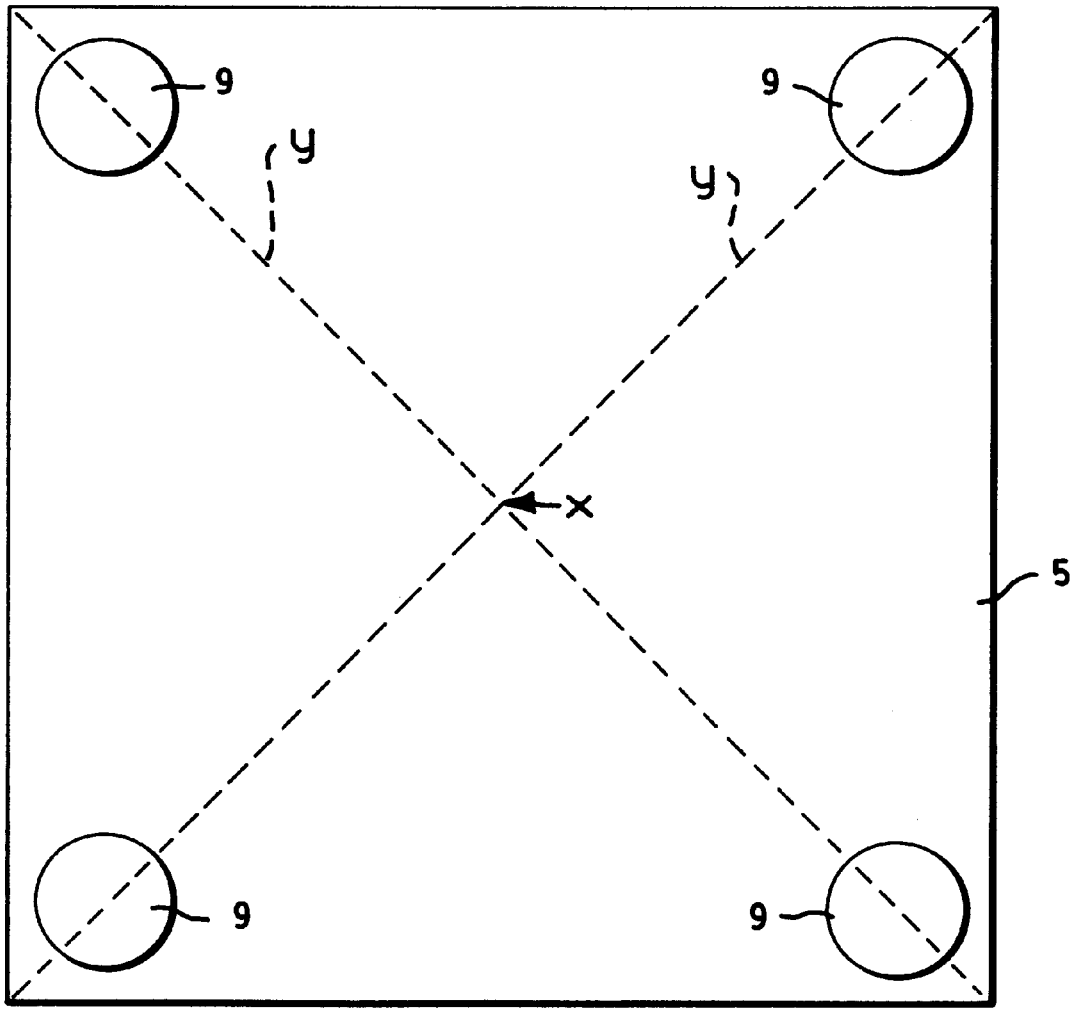
FIG. 7 shows a schematic representation of the arrangement of the motion means according to a further possible embodiment of the present invention.

In a further embodiment, similarly to what is illustrated in FIG. 7, the yoke (1) moving means (indicated for the sake of simplicity by four circles which represent the relevant motors (9)), can be disposed in correspondence of the angular portions of the frame (5). In the drawing, the motors (9) are shown, for clarity of representation, on the same plane of the frame (5) which is diagrammatically represented by a square figure. By [suitably] disposing the motors (9), together with the remaining relevant parts of the moving means, the plate (3) can be easily moved about an obique axis passing through said centre (x) and coincident, in the illustrated example, with a diagonal (y) of FIG. 7.

The said straight slide guides (4) make it possible to compensate for the variations of distance between the centre of each nut (7) and the centre of the floating plate (3) during the pivoting of the latter in the inclined direction.

The said flat element (31) is advantageously connected to the floating plate (3) by means of a plurality of slotted brackets (35) engaged with corresponding idle pulleys (36) supported by the floating plate (3), and is also provided with an arc-shaped sector gear (32) able to mesh with a helical toothed screw (33) associated to a corresponding motor member (34) to allows for the rotation of the same flat element (31) and thus of the yoke (1) about the said longitudinal axis (h—h) of the tube (T).

Associated to each of said slides (4) is a corresponding linear transducer (10) allowing the detection of the instantaneous position thereof.

Each transducer (10) is connected to electronic microprocessor means to which the servomotors (9) are associated: the said electronic means, which operate the servomotors (9), being also connected to a system for sensing the errors of convergence of the electronic beams and of purity of the colors, so as to activate the servomotors (9) as a consequence of the detection of possible errors of convergence, of rotation and/or of purity. Both said means for processing and those for the detection of errors of convergence and purity, are constructed with a technology known per se by those skilled in the art and are not herein described in further details.

While the above described mechanism refers to the case of positioning a deflection yoke on the neck of a cathode-ray tube for the reproduction of colored images, it will be appreciated that the said mechanism is also apt for positioning objects of other nature, as initially said in this description.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

We claim:

1. Automatic object-positioning mechanism, comprising means for supporting the object under control (1), means for sensing positioning errors, means for moving the means which support the object under control (1), electronic microprocessor means, connected to the error-positioning detection means for activating the means which move the object-supporting means, characterized in that said means for supporting the object under control (1) consist of an element (31) and of an underlying floating plate (3) mounted on four straight guides (4) located respectively at the end of two orthogonal axes and to which ball joints (6) with relevant threaded bush (7) are associated; in that said means for moving the means which support the object under control (1) are made up of four worm screws (8) engaged to electric servomotors (9), said worm screws being oriented parallel to the centering axis (h—h) of the object under control (1), being supported by a fixed frame (5) and engaging the threaded bush (7) of said ball joints (6) so that, by suitably moving the pairs of opposite screws (8), there is obtained a corresponding movement of the object under control (1) about the centre (x) of the centering axis (h—h); and in that said flat element (31) for supporting the object under control (1) can freely rotate about the axis (h—h), independently of the floating plate (3), and is provided with at least one toothed element (32) mashing with a screw (33) driven by a motor (34) for the rotation of the flat element (31) and, thus, of the object under control (1) about said centering axis (h—h).

2. Automatic object-positioning mechanism according to claim 1, characterized in that one axis barycentric of the floating plate (3) passes through each pair of opposite ball joints (6).

3. Automatic object-positioning mechanism according to claim 1, characterized in that said toothed element (32) is developed as a circular sector.

4. Automatic object-positioning mechanism according to claim 1, characterized in that the said flat element (31) has a circular profile and is connected to the underlying floating plate (3) by means of two slotted brackets (35) engaged with corresponding idle pulleys (36) mounted on the floating plate (3).

5. Automatic object-positioning mechanism according to claim 1, characterized in that the two pairs of opposite screws (8) define two planes orthogonal to each other and passing through the barycenter of the floating plate (3).

* * * * *